US012540425B2

(12) United States Patent
Nury et al.

(10) Patent No.: US 12,540,425 B2
(45) Date of Patent: Feb. 3, 2026

(54) COMPRESSION HOSIERY

(71) Applicant: DBI OPERATIONS EUROPE SAS, Rueil-Malmaison (FR)

(72) Inventors: Christophe Nury, Curgy (FR); Laurent Massotte, Tavernay (FR); Florence Mathieu, Etang sur Arroux (FR); Florent Moret, Autun (FR); Pascal Forestier, La Grande Verrière (FR)

(73) Assignee: DBI Operations Europe SAS, Rueil-Malmaison (FR)

( * ) Notice: Subject to any disclaimer, the term of this patent is extended or adjusted under 35 U.S.C. 154(b) by 856 days.

(21) Appl. No.: 17/631,864

(22) PCT Filed: May 29, 2020

(86) PCT No.: PCT/EP2020/064981
§ 371 (c)(1),
(2) Date: Jan. 31, 2022

(87) PCT Pub. No.: WO2021/028090
PCT Pub. Date: Feb. 18, 2021

(65) Prior Publication Data

US 2022/0282411 A1 Sep. 8, 2022

(30) Foreign Application Priority Data

Aug. 14, 2019 (EP) ..... 19315093

(51) Int. Cl.
*D04B 1/24* (2006.01)
*D02G 3/32* (2006.01)

(52) U.S. Cl.
CPC ..... *D04B 1/243* (2013.01); *D02G 3/328* (2013.01)

(58) Field of Classification Search
None
See application file for complete search history.

(56) References Cited

U.S. PATENT DOCUMENTS 4,502,301 A * 3/1985 Swallow ..... A61F 13/08 66/178 A
2010/0005568 A1 1/2010 Smith et al.

FOREIGN PATENT DOCUMENTS

CN 102088938 6/2011
CN 103564666 2/2015
(Continued)

OTHER PUBLICATIONS

PCT International Preliminary Report on Patentability in International Appln. No. PCT/EP2020/064981, dated Feb. 24, 2022, 10 pages.

(Continued)

*Primary Examiner* — Lynda Salvatore
(74) *Attorney, Agent, or Firm* — Fish & Richardson P.C.

(57) ABSTRACT

A compression hosiery garment includes a knit fabric including a first yarn and a second yarn knit in an alternating knit construction and having at least one course of the second yarn for each course of the first yarn. The first yarn includes a covered yarn with an elastic core, such as a soft modulus elastic core, and the second yarn includes an inelastic yarn. The alternating knit construction includes an inverse course shift, where the first yarn is knit with a first course height that is greater than a second course height of the second yarn.

15 Claims, 3 Drawing Sheets

(56) References Cited

FOREIGN PATENT DOCUMENTS

| | | | | |
|---|---|---|---|---|
| CN | 108697536 | | | 10/2018 |
| JP | H07138850 | | | 5/1995 |
| JP | 09111505 | A | * | 4/1997 |
| JP | H09111505 | | | 4/1997 |
| JP | 2005325486 | | | 11/2005 |
| WO | WO2015070774 | | | 5/2015 |

OTHER PUBLICATIONS

Extended European Search Report in EP Appln. No. 19315093.5, dated Apr. 3, 2020, 12 pages.
PCT International Search Report and Written Opinion in International Appln. No. PCT/EP2020/064981, dated Aug. 4, 2020, 17 pages.
Machine Translation of Office Action issued in Chinese Patent Application No. 202080072018.6, dated Aug. 2, 2023, 11 pages.
Office Action issued in Chinese Patent Application No. 202080072018.6, dated Aug. 2, 2023, 12 pages (with partial English Translation).
Ayodele et al., "The Effect of Miss and Tuck Stitches on a Weft Knit Strain Sensor," Sensors, Jan. 7, 2021, 21(2):358, 20 pages.
Merriam-Webster.com [online], "Fiber," Apr. 24, 2009, retrieved from URL <https://www.merriam-webster.com/dictionary/fiber>, 2 pages.
Office Action issued in European Patent Application No. 19315093.5, dated Jul. 1, 2021, 4 pages.

* cited by examiner

COMPRESSION HOSIERY

TECHNICAL FIELD

This disclosure relates to compression garments, such as stockings, hosiery, and other lower body garments.

BACKGROUND

Compression garments are used in the hosiery industry to provide comfort and support to a wearer. Standard hosiery garments provide a lesser degree of compression to a wearer than medical compression garments, and are measured under different standards. For example, in France and in other European countries, hosiery garments are evaluated under a technical standard for pressure and compression: British Standard BS 661210: 2018 "Graduated compression hosiery, anti-embolism hosiery and graduated support hosiery—Specification". This British Standard specifies requirements and test methods for assessing the compression and stiffness of graduated compression hosiery. On the other hand, in France and in other European countries, medical compression garments are evaluated under medical standard NF G30-102—"Textiles—Knitted goods—Determination of restraining force".

SUMMARY

This disclosure describes compression hosiery garments with an alternating knit construction and an inverse course shift.

In some aspects of the disclosure, a compression hosiery garment includes a knit fabric having a first yarn and a second yarn knit in an alternating knit construction with at least one course of the second yarn for each course of the first yarn, the first yarn including a covered yarn having an elastic core, and the second yarn comprising an inelastic yarn. The alternating knit construction includes an inverse course shift, where the first yarn is knit with a first course height that is greater than a second course height of the second yarn.

This, and other aspects, can include one or more of the following features. The elastic core can include a soft modulus elastane core. The covered yarn can include an inelastic sheath over the elastic core. The inelastic sheath can include at least one inelastic wrapping fiber over the elastic core. The at least one inelastic wrapping fiber can include two inelastic wrapping fibers. An inverse course offset between the first course height and the second course height can be between 0.2 millimeters and 0.6 millimeters. At least a portion of the knit fabric can include a compression value of at least 10 millimeter of mercury (mmHg). The knit fabric can include a level of transparency between 15 Denier (D) and 50 D. The garment can include a progressive compression zone of the knit fabric, where a first compression value at a first longitudinal end of the progressive compression zone is greater than a second compression value at a second, opposite longitudinal end of the progressive compression zone. Compression of the first progressive compression zone can gradually decrease from the first longitudinal end to the second longitudinal end. The compression hosiery garment can further include a first constant compression zone adjacent the first progressive compression zone, where a compression value of the first constant compression zone is generally constant throughout the first constant compression zone, and the compression value of the first constant compression zone is the same as a compression value of an adjacent longitudinal end of the adjacent first compressive compression zone. The compression hosiery garment can further include a second progressive compression zone, a second constant compression zone, and a third constant compression zone, where the first constant compression zone is positioned at an upper thigh area of the garment, the first progressive compression zone is positioned at a lower thigh area of the garment, the second constant compression zone is positioned at a knee area of the garment, the second progressive compression zone is positioned at a lower leg area of the garment, and the third constant compression zone is positioned at a foot of the garment. The garment can comply with the stiffness test under section A.5.3 of Annex A of British Standard BS 661210: 2018. The knit fabric can exclude an in-laid weft yarn.

Certain aspects of the disclosure encompass a method of manufacturing a compression hosiery garment. The method includes knitting a fabric including a first yarn and a second yarn knit with an alternating knit construction having at least one course of the second yarn for each course of the first yarn, the first yarn including a covered yarn having an elastic core, the second yarn including an inelastic yarn. Knitting with the alternating knit construction includes knitting an inverse course shift, where the first yarn is knit with a first course height that is greater than a second course height of the second yarn.

This, and other aspects, can include one or more of the following features. Knitting with the alternating knit construction can include knitting courses of the first yarn with a looser tension than adjacent knit courses of the second yarn. The elastic core can include a soft modulus elastane core. The covered yarn can include an inelastic sheath over the elastic core, and the inelastic sheath can include at least one inelastic wrapping fiber over the elastic core. Knitting the inverse course shift can include knitting a course offset between the first course height and the second course height that is between 0.2 millimeters and 0.6 millimeters. At least a portion of the knit fabric can include a compression value of at least 10 mmHg. The knit fabric can be knit to comprise a level of transparency between 15 D and 50 D. Knitting the fabric can include knitting a first progressive compression zone of the knit fabric, where a first compression value at a first longitudinal end of the progressive compression zone is greater than a second compression value at a second, opposite longitudinal end of the progressive compression zone. Compression of the first progressive compression zone can gradually decrease from the first longitudinal end to the second longitudinal end. Knitting the fabric can further include knitting a first constant compression zone adjacent the first progressive compression zone, where a compression value of the first constant compression zone is generally constant throughout the first constant compression zone, and the compression value of the first constant compression zone is the same as a compression value of an adjacent longitudinal end of the adjacent first compressive compression zone. Knitting the fabric can further include knitting a second progressive compression zone, a second constant compression zone, and a third constant compression zone, where the first constant compression zone is positioned at an upper thigh area of the garment, the first progressive compression zone is positioned at a lower thigh area of the garment, the second constant compression zone is positioned at a knee area of the garment, the second progressive compression zone is positioned at a lower leg area of the garment, and the third constant compression zone is positioned at a foot of the garment. Knitting the fabric can exclude knitting an in-laid weft yarn. Knitting the fabric can include knitting a leg portion of the compression hosiery garment with the fabric. The method can further include knitting a panty portion of the compression hosiery garment, and connecting the panty portion to the leg portion to form the compression hosiery garment. The method can further include knitting a waistband portion, connecting the waistband portion to the panty portion, knitting a bottom end portion, and connecting the bottom end portion to the leg portion to form the compression hosiery garment.

The details of one or more implementations of the subject matter described in this disclosure are set forth in the accompanying drawings and the description below. Other features, aspects, and advantages of the subject matter will become apparent from the description, the drawings, and the claims.

BRIEF DESCRIPTION OF THE DRAWINGS

Like reference numbers and designations in the various drawings indicate like elements.

DETAILED DESCRIPTION

Figure 1:
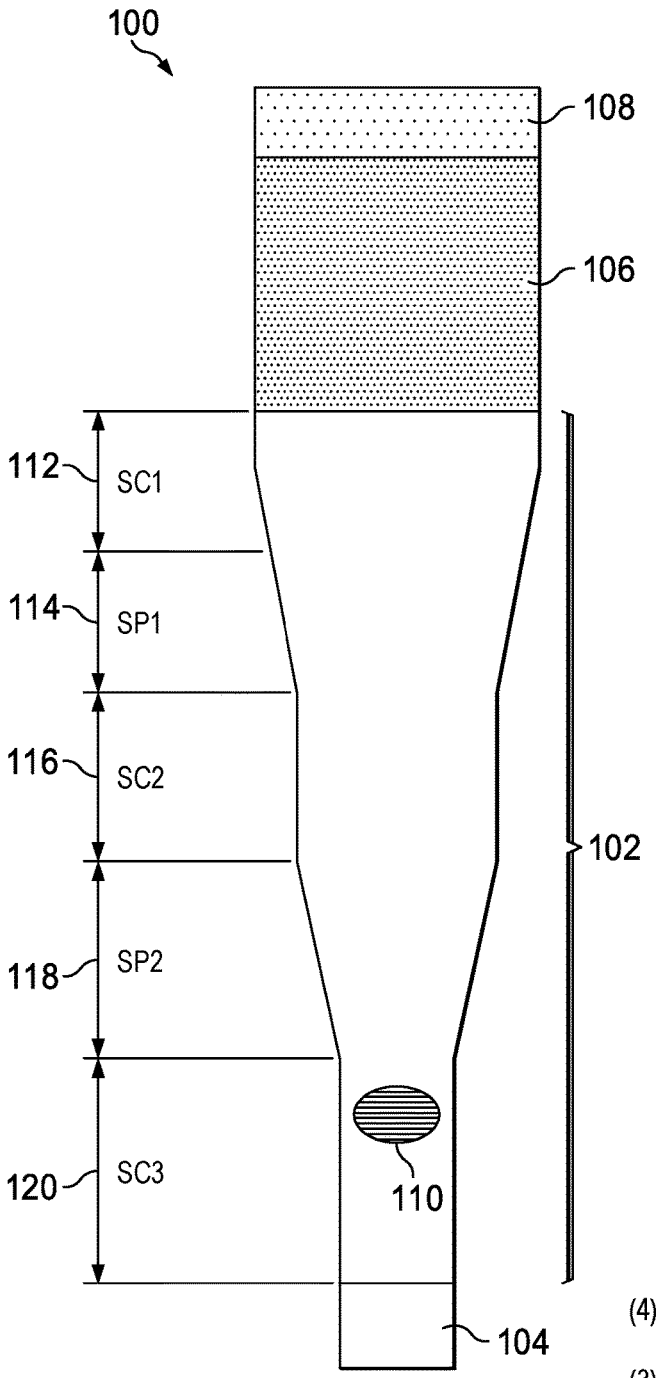
FIG. 1 is a schematic view of an example compression hosiery garment.

This disclosure regards compression hosiery garments, such as tights, stockings, knee-highs, stay-ups, or other lower body shapewear or comfort wear, with leg portions that include an alternating knit construction with an inverse course shift. This disclosure also regards the method of manufacturing these compression hosiery garments. The leg portions of the garments include a covered yarn with a flexible soft modulus elastic core, and can be knit on a standard knitting machine (as opposed to a medical knitting machine). The compression hosiery garments include an alternating course knit of the covered elastic yarn and an inelastic yarn knit, where the covered elastic yarn is used on every other course, with the other courses being knitted with less expensive inelastic yarn.

The alternating knit construction includes an inverse course shift, which means that the course of covered elastic yarn is knit looser relative to the course of inelastic yarn of the alternating knit construction. This relative looseness when knit, creates a course height of the covered elastic yarn that is larger than the course height of the successive, or adjacent, course of inelastic yarn. The difference in the course height of the covered elastic yarn and the course height of the inelastic yarn is called the course offset. In some implementations, the course offset is between 0.2 millimeters (mm) and 0.6 mm, in that the course height of the covered elastic yarn is 0.2 mm to 0.6 mm greater than the course height of the inelastic yarn. The degree that the covered elastic yarn is loosened relative to the inelastic yarn (e.g., the size of the course offset) affects, and can determine, the compressibility and stretchability of the resulting fabric. The leg portion of the compression hosiery garment has a morphological pressure profile that progressively decreases starting from an ankle area to a calf area and further to a thigh area of the garment. The way the covered elastic yarn and inelastic yarn are constructed and knit (i.e., with the alternating construction with inverse course shift) to form the leg portion(s) of a compression hosiery garment are described in more detail later.

In some conventional hosiery garments, leg portions of garments can be knit with an alternating knit construction having an elastic yarn and an inelastic yarn knit with or without a course shift, wherein the inelastic yarn is knit the same or looser relative to how the elastic yarn is knit. Some conventional knitting machines include yarn feeders or ultra-feeders (i.e., feeders that control the tension of a yarn as a fabric is knit). For example, a four-course loom knitting machine can include four yarn feeders, where two yarn feeders are dedicated to an elastic yarn and two yarn feeders are dedicated to an inelastic yarn, and the conventional hosiery garments include an elastic yarn that is knit with the same or greater coursewise tension (and thereby a smaller course height) than an adjacent course of inelastic yarn. Also, conventional medical compression garments are often knit with an in-laid weft yarn, and are knit on a medical knitting machine (or medical loom). Medical knitting machines are more expensive than standard knitting machines, for example, in order to knit the weft yarn into a medical garment and control coursewise yarn tensions and handle medical-gauge yarns according to medical garment standards. For example, a medical compression garment can be knit on a medical knitting machine (or medical loom) with ultra-feeders, where some (e.g., two) ultra-feeders are dedicated to the in-laid weft yarn and some (e.g., two) ultra-feeders provide a covered elastic yarn with a tight tension. The present disclosure describes compression hosiery garments having leg portions knit with an alternating knit construction having an inverse course shift, where an inelastic yarn is knit with a greater course height (for example, by knitting with a tighter coursewise tension) than a course height of an elastic yarn of the alternating knit construction. Also, the compression hosiery garments of the present disclosure can be knit on a standard knitting machine (e.g., without requiring a medical knitting machine), and achieve a progressive morphological pressure profile along leg portions of the garment that progressively decreases starting from a lower end (e.g., an ankle portion) toward a higher end (e.g., toward a calf area and, in some instances, to a thigh area). Further, the alternating knit construction with the inverse course shift provides a level of transparency to the fabric of 15 Denier (D) to 50 D. While Denier is a unit of linear density of a yarn, it is understood in the hosiery industry to indicate an opacity or sheer level of a fabric. For example, a transparent item (sheer) is indicated as 15 D to 30 D, and a semi-opaque item is indicated as 40 D to 50 D.

The term "inelastic yarn" and "elastic yarn" as used herein are terms generally understood in the art, and an "inelastic yarn" is relatively less elastic than an "elastic yarn." In some examples, an inelastic yarn can include polyamide, nylon, polyester, or other synthetic material or material mixture, wool, cotton, or other natural material or material mixture, viscose or other artificial material, other material, or a combination of these. In certain instances, the inelastic yarn can include a flat yarn, textured yarn, or other yarn type. In some examples, an elastic yarn can include spandex or another elastane, and includes a covered yarn, such as a core-and-sheath yarn with a soft modulus elastane core.

FIG. 1 is a schematic view of an example compression hosiery garment 100 that includes a knitted leg portion 102. The example garment 100 also includes a bottom end portion 104 connected to the leg portion 102 at a bottom longitudinal end of the leg portion 102, a panty portion 106 connected at a top longitudinal end of the leg portion 102, and a waistband portion 108 forming a top longitudinal end of the example garment 100. The portions of the garment 100 can be continuously knit together, or can be knit (or otherwise formed) and connected together to form the garment 100. In some examples, part of or the entire example garment 100 is circularly knit on a circularly knitting machine, for example, a Lonati knitting machine with four yarn feeders.

Though the schematic view of FIG. 1 appears to show the example garment 100 as having only one leg portion 102, the example garment 100 includes two leg portions 102, specifically, a first (right) leg portion and a second (left) leg portion. The right leg portion and the left leg portion are constructed in a similar fashion, and take the form of the leg portion 102 of the example garment of FIG. 1. However, garments of the present disclosure can take the form of a high sock, footwear, or other shapewear garment having one or two leg portions.

The leg portion 102 of the example compression hosiery garment 100 includes a knit fabric having a first yarn and a second yarn knit in an alternating knit construction. The alternating knit constructions includes at least one course of the second yarn for each course of the first yarn, for example, the first yarn and the second yarn alternate courses to form the knit fabric. The first yarn is a covered yarn having a soft modulus, flexible elastic core, and the second yarn is an inelastic yarn. The knit fabric with alternating knit construction also includes an inverse course shift, where the first yarn is knit with a first course height that is greater than a second course height of the second yarn. The difference in the first course height and the second course height is the course offset. In some implementations, the course offset of the inverse course shift is at or between 0.2 mm and 0.6 mm, where the first course height is 0.2 mm to 0.6 mm greater than the second course height. The larger the knitted loops of the first yarn are knit, without a corresponding increase in the knitted loops of the second yarn, the larger the course offset becomes. Thus, a larger course offset means more of the first yarn is used in knitting the respective course. The alternating knit construction with inverse course shift also provides the knit fabric of the leg portion 102 with a level of transparency that can vary between 15 D and 50 D. In some examples, at least 20% of the final composition of the leg portion 102 of the example garment 100 is the content of the elastane of the covered yarn.

Figure 2:
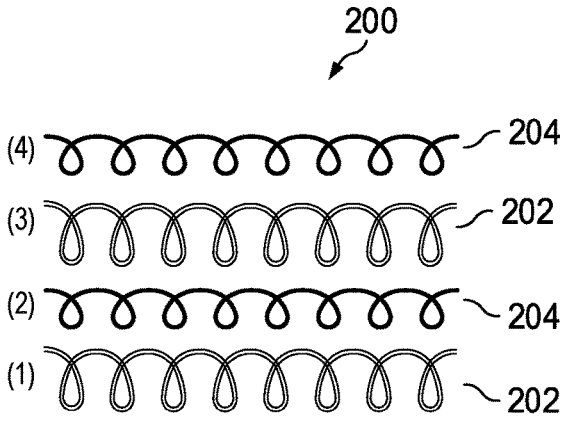
FIG. 2 is a schematic view of an example alternating knit construction with inverse course shift.

FIG. 2 is a schematic view of an example alternating knit construction 200 with inverse course shift, which can be used in the knit fabric of the leg portion 102 of example garment 100 of FIG. 1. For example the alternating knit construction 200 of FIG. 2 shows the first yarn type 202 on a first course (1), the second yarn type 204 on a second course (2), the first yarn type 202 on a third course (3), and the second yarn type 204 on a fourth course (4), in an alternating pattern along the courses. FIG. 2 schematically shows the courses of the example knit pattern 200 as separate from each other, but it is understood that adjacent courses of the alternating knit construction would be knitted together with a knitted loop stitch at the adjacent loops on adjacent courses. In some implementations, mesh effects can be used to obtain patterns on the leg portion 102 or other portion of the example garment 100, such as placed, continuous, or repeated patterns. For example, the knit construction can incorporate held loops, float patterns, load patterns, drop stitches, partial tuck patterns, or other knit styles to achieve certain patterns, compression values, or other overall features of a knitted fabric. Also, additional yarns or threads can be added to give reinforcement, opacity, or other features, such as a false heel or a placed pattern.

The first yarn 202 is knit looser relative to the second yarn 204 of the alternating knit construction 200. This relative looseness creates the greater knit course height of the first yarn 202 than the knit course height of the adjacent second yarn 204 on the subsequent course. The course offset between the first yarn 202 and the subsequent second yarn 204 is between 0.2 mm and 0.6 mm, in that the course height of the first yarn 202 is 0.2 mm to 0.6 mm greater than the course height of the second 204 yarn. The degree that the first yarn 202 is loosened relative to the second yarn 204 (e.g., the size of the course offset) affects, and can determine, the compressibility and stretchability of the knit fabric of the leg portion 102 or portions of the leg portion 102. For example, a smaller course offset results in a smaller compression capacity and smaller stretchability relative to a larger course offset, which would result in a greater compression capacity and greater stretchability. The alternating knit construction of example knit pattern 200 excludes an in-laid weft yarn. In-laid weft yarns are used in medical compression garments to provide desired compression values.

Referring to both FIGS. 1 and 2, and as mentioned earlier, the first yarn 202 is a covered yarn with a flexible, low modulus elastic core and the second yarn 204 is an inelastic yarn. The first yarn 202 and the second yarn 204 can take a number of forms and include various different materials, but the first yarn is more elastic than the second yarn. For example, the covered yarn can include an inelastic sheath over the elastic core, forming a core-and-sheath yarn. The first yarn can be single-covered or double-covered. For example, the inelastic sheath can include one or more inelastic wrapping fibers over the elastic core. In some examples, the inelastic sheath includes two inelastic wrapping fibers. The flexible elastic core includes a soft modulus (i.e., low modulus, or flexible modulus) spandex or other soft modulus elastane. As referenced herein, "modulus" refers to the modulus of elasticity. In some instances, the flexible soft modulus elastic core has a sufficiently high titration of greater than or equal to 70 dTex, where dTex is a measure of linear density in units of grams per 10 kilometers. For example, the flexible elastic core can include Lycra® T902C fiber, Roica™ HS (by Asahi Kasei), X4zol™ J Fiber (by Lubrizol), other soft modulus elastane, or a combination of these, to form the soft modulus elastic core. The flexible soft modulus elastane has a greater elongation than standard spandex under application of the same force, and has a stretch-back recovery that is similar to regular spandex. In some instances, the soft modulus elastane is flexible in that the elastane provides a greater range of elastomeric characteristics, for example, as compared to standard spandex material. Covering the flexible elastic core with the inelastic sheath (e.g., the one, two, or more inelastic wrapping fibers) results in a covered yarn with desired mechanical properties in force elongation, allowing a better control of compression, and provides increased durability to the yarn and an increased comfort (for example, against skin of a wearer) than a bare elastic core yarn, since bare elastic spandex can be abrasive, sensitive, and otherwise uncomfortable against the skin of a wearer.

The inelastic yarn of the second yarn type 204 can take many forms. In some instances, the material of the inelastic yarn includes polyamide, nylon, polyester, or other synthetic material or material mixture, wool, cotton, or other natural material or material mixture, viscose or other artificial material, other material, or a combination of these. In certain instances, the inelastic yarn can include a flat yarn, textured yarn, or other yarn type. Similarly, the inelastic wrapping fibers of the covered yarn of the first yarn type 202 can include polyamide, nylon, polyester, other synthetic material, wool, cotton, other natural material, viscose, other artificial material, a material mixture, other material, or a combination of these. The inelastic wrapping fiber(s) can be flat, textured, or another type.

The leg portion(s) 102 of the example garment 100 have a morphological pressure profile that, generally, progressively decreases starting from a bottom end (e.g., an ankle area) to a middle portion (e.g., to a calf area) and further to a top end (e.g., a thigh area) of the leg portion 102. For example, the leg portion 102 includes a foot and ankle portion 120, a lower leg portion 118 configured to be placed adjacent the calf of a wearer, a middle leg portion 116 configured to be placed adjacent the knee of the wearer, a first upper leg portion 114 configured to be placed at a lower thigh of the wearer, and a second upper leg portion 112 configured to be placed at an upper thigh of the wearer, where these portions (118, 116, 114, and 112), sequentially placed, form the leg portion 102 from a bottom end of the leg portion 102 (adjacent the bottom end portion 104, e.g., a toe end) to a top end of the leg portion 102 (adjacent the panty 106). In some instances, the foot and ankle portion 120 includes a heel 110 formed in the knit fabric (e.g., knit into, coupled to, or otherwise connected to the foot and ankle portion 120). Each of these portions (112, 114, 116, 118, and 120) includes the alternating knit construction 200 with inverse course shift, and provide a compression value per length of fabric, often measured as a pressure value in millimeters of mercury (mmHg). The compression value, or pressure value, can be the same or different among the portions of the leg portion 102. For example, the leg portion can include a generally progressive pressure profile, where a pressure value of the leg portion 102 generally decreases (e.g., gradually, linearly, in sections, or otherwise) starting from the foot and ankle portion 120 to the second upper leg portion 112. In one example, the foot and ankle portion 120 provides a generally constant pressure value of between 10 and 12 mmHg, and the pressure value decreases moving up the leg portion 102 to the second upper leg portion 112, which can have a pressure value of about 5 mmHg. In another example, the foot and ankle portion 120 provides a generally constant pressure value of about 10 mmHg, and the pressure value decreases moving up the leg portion 102 to the second upper leg portion 112, which can have a pressure value of about 5 mmHg. The pressure values can vary in the portions of the leg portion 102. In some examples, the foot and ankle portion 120 has a maximum pressure value of about 10 mmHg, about 9 mmHg, or about 8 mmHg. The size of the course offset in the alternating knit construction with inverse course shift can vary in the portions of the leg portion 102 to provide the different pressure values. For example, as the course offset increases in size, the corresponding compression value decreases, and as the course offset decreases in size, the corresponding compression value increases.

The pressure value in mmHg is a pressure value of a fabric as it relates to a technical standard for compression: British Standard BS 661210: 2018 "Graduated compression hosiery, anti-embolism hosiery and graduated support hosiery—Specification". For example, Annex A of this British Standard specifies requirements and test methods (e.g., HATRA Mark II compression testing) for assessing the compression and stiffness of graduated compression hosiery and graduated support hosiery, where a "compression profile" relates to the pressure exerted by the hosiery along the leg it is intended to fit. While we refer to "compression hosiery" throughout the disclosure, the disclosure is intended to cover both compression hosiery and support hosiery, as described in the British Standard. For example, in this British Standard, the determination of compression or support hosiery depends at least partly on the applied pressure provided at the ankle (e.g., compression hosiery provides 10-14 mmHg at the ankle, and support hosiery describes 6-12 mmHg at the ankle). The pressure profiles described here are related to the standards measurement method, where the standard applies circumferences on a garment that replicate the morphology of a leg of a wearer, which is not linear or even exactly cylindrical. For example, the foot-and-ankle portion 120 can have a pressure value of about 10 mmHg, which is considered "firm" in the BS 661210 standard, a pressure value of about 12 mmHg, which is considered "extra firm" in the BS 661210 standard, or a pressure value between 10 mmHg and 12 mmHg. It would be understood that the actual compression and pressure that a wearer of the example garment 100 with the leg portion 102 feels would vary based on the size and shape of the legs of the wearer. For example, though the second upper leg portion 112 may include a generally constant pressure value of, e.g., 5 mmHg, the compression that the wearer feels may differ from longitudinal end to opposite longitudinal end of the upper leg portion 112 since the upper thigh of wearers may vary in size between the longitudinal ends of the second upper leg portion 112. In some implementations, the leg portion 102 of the example hosiery garment 100 of FIG. 1 complies with the stiffness test in section A.5.3 of Annex A of the British Standard.

In some implementations, the leg portion 102 includes a progressive compression zone of the knit fabric, for example, at one of the band-shaped portions of the leg portion 102. In the progressive compression zone, a first compression value (or pressure value) at a first (lower) longitudinal end of the progressive compression zone is greater than a second compression value at a second (upper), opposite longitudinal end of the progressive compression zone. Compression in the first progressive compression zone gradually (e.g., linearly) decreases from the first longitudinal end to the second longitudinal end. In certain implementations, the leg portion includes a constant compression zone adjacent the progressive compression zone, wherein a compression value of the first constant compression zone is generally constant (i.e., exactly or substantially constant) throughout the constant compression zone.

In some examples, the leg portion 102 includes one or more progressive compression zones and one or more constant compression zones distributed along a longitudinal length of the leg portion 102, generally forming bands of progressive or constant compression zones along the leg portion 102. In the example garment 100 of FIG. 1, a first constant compression zone (SC1) is positioned at the second upper leg portion 112, a first progressive compression zone (SP1) is positioned at the first upper leg portion 114, a second constant compression zone (SC2) is positioned at the middle leg portion 116, a second progressive compression zone (SP2) is positioned at the lower leg portion 118, and a third constant compression zone (SC3) is positioned at the foot and ankle portion 120. In an example implementation, zone SC3 has a pressure value of (exactly or substantially) 10 mmHg, zone SP2 has a pressure value that decreases from 10 to 7 mmHg between the bottom longitudinal end (adjacent SC3) and top longitudinal end (adjacent SC2), zone SC2 has a pressure value of (exactly or substantially) 7 mmHg, zone SP1 has a pressure value that decreases from 7 to 5 mmHg between the bottom longitudinal end (adjacent SC2) and top longitudinal end (adjacent SC1), and zone SC1 has a pressure value of (exactly or substantially) 5 mmHg. In the constant compression zones (SC1, SC2, and SC3), the nominal compression is generally constant, in that the pressure value in these zones remains generally constant (e.g., within a plus-or-minus 5% range in pressure value) along its respective longitudinal length. However, the constant compression zones may not necessarily impart a constant compression on the wearer, as the compression may vary because the measurement method simulates the morphology and shape of the leg, which is not necessarily cylindrical or conical (e.g., it is similar to a cone with two bulging zones at the calf and thigh). In the progressive compression zones (SP1 and SP2), the compression decreases from the longitudinal bottom of the respective zone to the longitudinal top of the respective zone, and therefore have a pressure that varies along the respective zone. The progressive compression zones (SP1 and SP2) have a linearly progressive change in knit construction along its longitudinal length to impart respective compression values. However, as mentioned earlier, the result of the compression (related to the measurement method that simulates the morphology of the leg of a wearer) may vary. The progressive compression zones (SP1 and SP2) provide transition between the constant compression zones (SC1, SC2, and SC3), where the pressure value along the leg gradually decreases instead of, for example, providing gaps or jumps in pressure values moving up the leg. The compression value at each longitudinal end of the progressive compression zones (SP1 and SP2) is equal to the respective adjacent constant compression zone (SC1, SC2, and SC3), such that there is continuity between all zones of the leg portion 102. The overall nominal compression of the leg portion 102 decreases from the foot-and-ankle zone 120 toward the middle leg portion 116 (e.g., approximate the knee of the wearer) and to the second upper leg portion 112 (e.g., approximate the upper thigh of the wearer).

The heel portion 110, panty 106, waistband portion 108, and bottom end portion 104 can have a different knit construction than the zones of the leg portion 102. For example, the heel portion 110 can include a covered polyamide yarn and a standard polyamide yarn knit in an alternating construction, the panty 106 can include a standard knitted mesh for hosiery, the waistband portion 108 can include a covered polyamide yarn and a standard polyamide yarn knit in an alternating construction, and the bottom end portion 104 can include a reinforced point. In some instances, the heel portion 110, panty 106, waistband portion 108, and/or bottom end portion 104 can be knit with different knit constructions and/or different materials.

Figure 3:
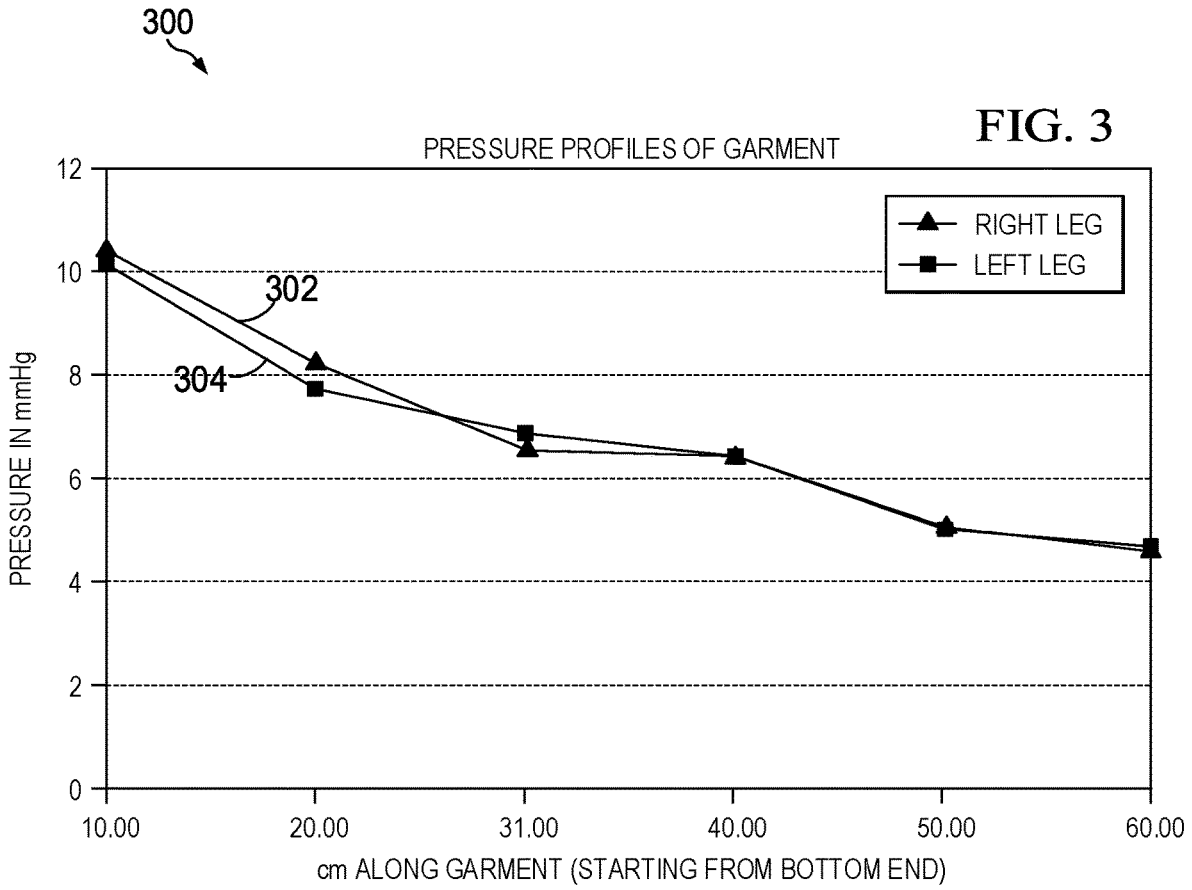
FIG. 3 is a chart of an example pressure profile of a compression hosiery garment.

FIG. 3 is a chart of an example pressure profile 300 of a compression hosiery garment, such as the example compression hosiery garment 100 of FIG. 1. In particular, the example pressure profile 300 includes example pressure values (in mmHg) for a right leg portion 302 and a left leg portion 304 of the example hosiery garment with respect to an approximate distance (in centimeters, or cm) upwards from a bottom longitudinal end of the example garment, where 10 cm approximates an ankle area of the leg portions 302 and 304, and 60 cm approximates the upper thigh area of the leg portions 302 and 304. As shown in the example pressure profile 300, the mmHg pressure values of the right leg portion 302 and left leg portion 304 are similar to each other, and progressively decrease as the distance along the example garment increases, starting from about 10 cm up from the bottom of the garment to about 60 cm up from the bottom of the garment. In the example pressure profile 300, the pressure value at the ankle is about 10.1 for the right leg 302 and about 10.4 mmHg for the left leg 304, the pressure value at the calf (i.e., about 31 cm) is about 6.6 mmHg for the right leg 302 and about 6.8 mmHg for the left leg 304, and the pressure value at the thigh (i.e., about 60 cm) is about 4.6 mmHg for the right leg 302 and about 4.7 mmHg for the left leg 304.

Figure 4:
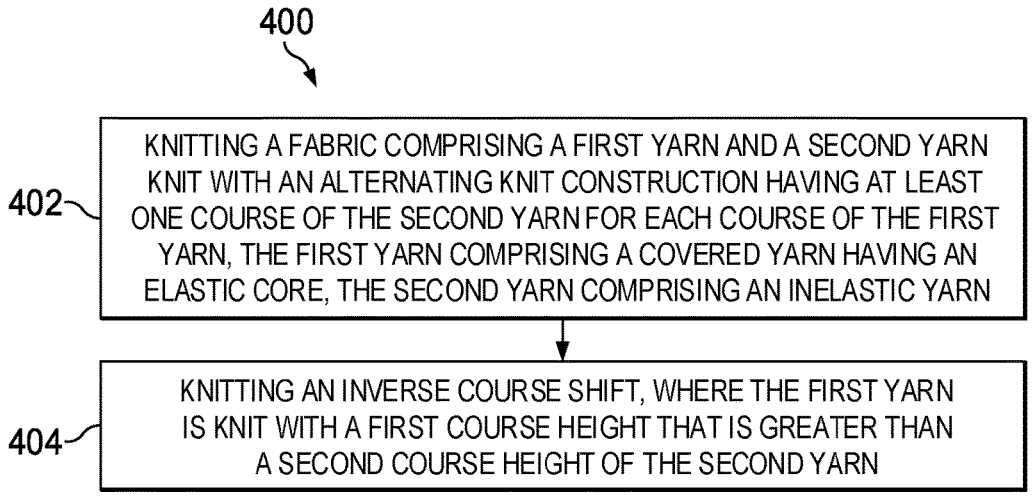
FIG. 4 is a flowchart of an example method for manufacturing a compression hosiery garment.

FIG. 4 is a flowchart of an example method 400 for manufacturing a compression hosiery garment, such as the example compression hosiery garment 100 of FIG. 1 with the alternating knit construction 200 of FIG. 2. At 402, a fabric comprising a first yarn and a second yarn is knit with an alternating knit construction having at least one course of the second yarn for each course of the first yarn. The first yarn includes a covered yarn having an elastic core, and the second yarn includes an inelastic yarn. At 404, an inverse course shift is knit in the alternating knit construction, where the first yarn is knit with a first course height that is greater than a second course height of the second yarn. The fabric can be knit on a standard knitting machine, such as a circular knit machine with four yarn feeders and four looms.

In some implementations, knitting with the alternating knit construction includes knitting courses of the first yarn with a looser tension than adjacent knit courses of the second yarn. Knitting the inverse course shift can include knitting an offset between the first course height and the second course height that is between 0.2 millimeters and 0.6 millimeters.

In some instances, knitting the fabric includes knitting a first progressive compression zone of the knit fabric, where a first compression value at a first longitudinal end of the progressive compression zone is greater than a second compression value at a second, opposite longitudinal end of the progressive compression zone. Compression of the first progressive compression zone gradually (e.g., linearly) decreases from the first longitudinal end to the second longitudinal end. Knitting the fabric can also include knitting a first constant compression zone adjacent the first progressive compression zone, wherein a compression value of the first constant compression zone is generally constant throughout the first constant compression zone. Knitting the fabric can also include knitting a second progressive compression zone, a second constant compression zone, and a third constant compression zone, where the first constant compression zone is positioned at an upper thigh area of the garment, the first progressive compression zone is positioned at a lower thigh area of the garment, the second constant compression zone is positioned at a knee area of the garment, the second progressive compression zone is positioned at a lower leg area of the garment, and the third constant compression zone is positioned at a foot of the garment.

Figure 5:
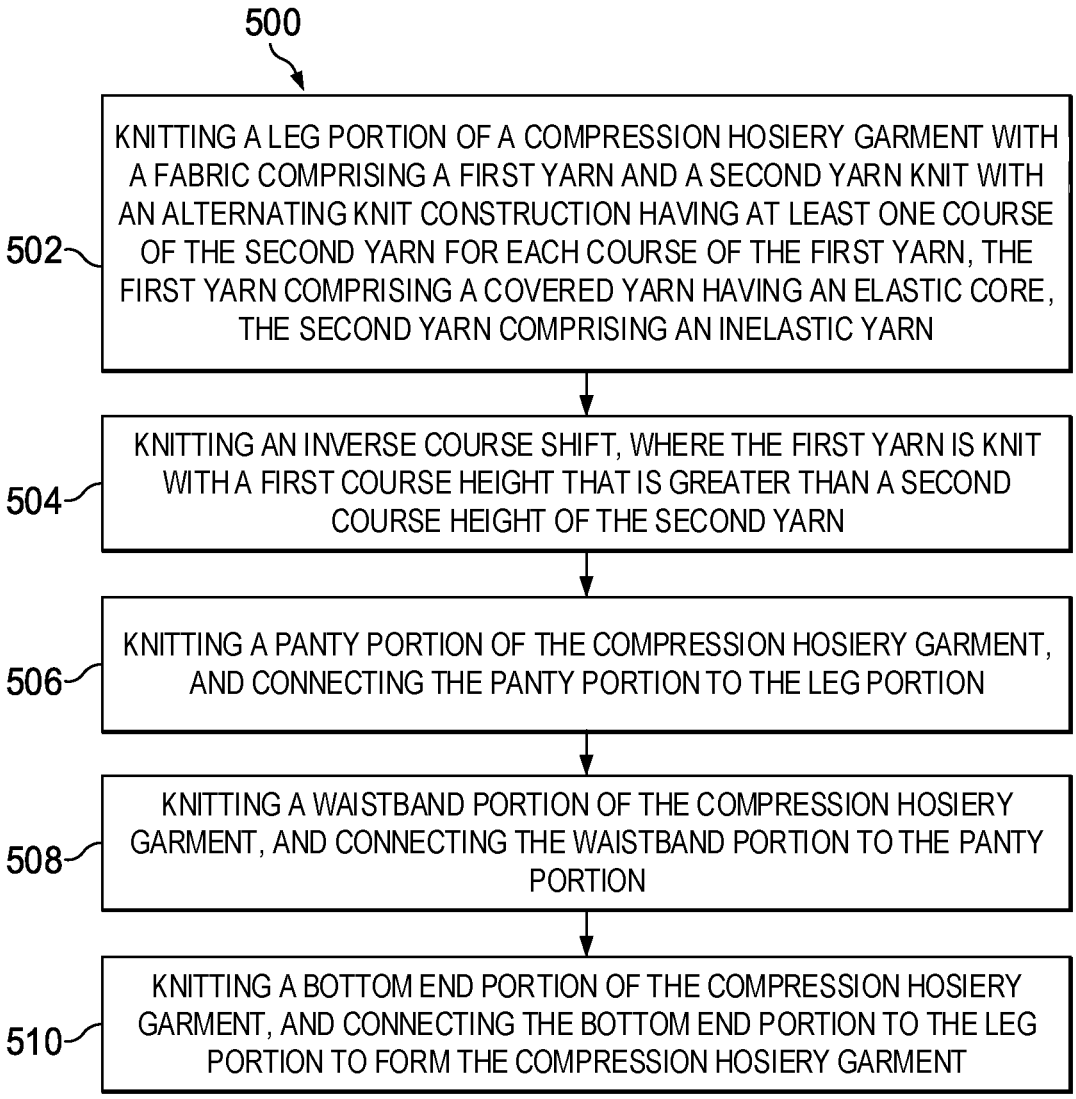
FIG. 5 is a flowchart of another example method for manufacturing a compression hosiery garment.

FIG. 5 is a flowchart of another example method 500 for manufacturing a compression hosiery garment, such as the example compression hosiery garment 100 of FIG. 1 with the alternating knit construction 200 of FIG. 2. At 502, a leg portion of a compression hosiery garment is knit with a fabric comprising a first yarn and a second yarn with an alternating knit construction having at least one course of the second yarn for each course of the first yarn. The first yarn includes a covered yarn having an elastic core, and the second yarn includes an inelastic yarn. At 504, an inverse course shift is knit in the alternating knit construction, where the first yarn is knit with a first course height that is greater than a second course height of the second yarn. The fabric can be knit on a standard knitting machine, such as a circular knit machine with four yarn feeders and four looms. At 506, a panty portion of the compression hosiery garment is knit and connected to the leg portion. At 508, a waistband portion of the compression hosiery garment is knit and connected to the panty portion. At 510, a bottom end portion of the compression hosiery garment is knit and connected to the leg portion to form the compression hosiery garment.

A number of implementations have been described. Nevertheless, it will be understood that various modifications may be made without departing from the spirit and scope of the disclosure.

EMBODIMENTS

Although the present invention is defined in the attached claims, it should be understood that the present invention can also (alternatively) be defined in accordance with the following embodiments:

1. A compression hosiery garment, comprising:
   a knit fabric comprising a first yarn and a second yarn knit in an alternating knit construction comprising at least one course of the second yarn for each course of the first yarn, the first yarn comprising a covered yarn having an elastic core, the second yarn comprising an inelastic yarn,
   wherein the alternating knit construction comprises an inverse course shift, where the first yarn is knit with a first course height that is greater than a second course height of the second yarn.
2. The compression hosiery garment of embodiment 1, wherein the elastic core comprises a soft modulus elastane core.
3. The compression hosiery garment of embodiment 1, wherein the covered yarn comprises an inelastic sheath over the elastic core.
4. The compression hosiery garment of embodiment 3, wherein the inelastic sheath comprises at least one inelastic wrapping fiber over the elastic core.
5. The compression hosiery garment of embodiment 4, wherein the at least one inelastic wrapping fiber comprises two inelastic wrapping fibers.
6. The compression hosiery garment of embodiment 1, wherein an inverse course offset between the first course height and the second course height is between 0.2 millimeters and 0.6 millimeters.
7. The compression hosiery garment of embodiment 1, wherein at least a portion of the knit fabric comprises a compression value of at least 10 millimeter of mercury (mmHg).
8. The compression hosiery garment of embodiment 1, wherein the knit fabric comprises a level of transparency between 15 Denier (D) and 50 D.
9. The compression hosiery garment of embodiment 1, wherein the garment comprises a progressive compression zone of the knit fabric, where a first compression value at a first longitudinal end of the progressive compression zone is greater than a second compression value at a second, opposite longitudinal end of the progressive compression zone.
10. The compression hosiery garment of embodiment 9, wherein compression of the first progressive compression zone gradually decreases from the first longitudinal end to the second longitudinal end.
11. The compression hosiery garment of embodiment 10, further comprising a first constant compression zone adjacent the first progressive compression zone, wherein a compression value of the first constant compression zone is generally constant throughout the first constant compression zone, and the compression value of the first constant compression zone is the same as a compression value of an adjacent longitudinal end of the adjacent first compressive compression zone.
12. The compression hosiery garment of embodiment 11, further comprising a second progressive compression zone, a second constant compression zone, and a third constant compression zone;
    where the first constant compression zone is positioned at an upper thigh area of the garment, the first progressive compression zone is positioned at a lower thigh area of the garment, the second constant compression zone is positioned at a knee area of the garment, the second progressive compression zone is positioned at a lower leg area of the garment, and the third constant compression zone is positioned at a foot of the garment.
13. The compression hosiery garment of embodiment 1, wherein the garment complies with the stiffness test under section A.5.3 of Annex A of British Standard BS 661210: 2018.
14. The compression hosiery garment of embodiment 1, wherein the knit fabric excludes an in-laid weft yarn.
15. A method of manufacturing a compression hosiery garment, the method comprising:
    knitting a fabric comprising a first yarn and a second yarn knit with an alternating knit construction having at least one course of the second yarn for each course of the first yarn, the first yarn comprising a covered yarn having an elastic core, the second yarn comprising an inelastic yarn,
    wherein knitting with the alternating knit construction comprises knitting an inverse course shift, where the first yarn is knit with a first course height that is greater than a second course height of the second yarn.
16. The method of embodiment 15, wherein knitting with the alternating knit construction comprises knitting courses of the first yarn with a looser tension than adjacent knit courses of the second yarn.
17. The method of embodiment 15, wherein the elastic core comprises a soft modulus elastane core.
18. The method of embodiment 15, wherein the covered yarn comprises an inelastic sheath over the elastic core, and the inelastic sheath comprises at least one inelastic wrapping fiber over the elastic core.
19. The method of embodiment 15, wherein knitting the inverse course shift comprises knitting a course offset between the first course height and the second course height that is between 0.2 millimeters and 0.6 millimeters.
20. The method of embodiment 15, wherein at least a portion of the knit fabric comprises a compression value of at least 10 mmHg.
21. The method of embodiment 15, wherein the knit fabric is knit to comprise a level of transparency between 15 D and 50 D.
22. The method of embodiment 15, wherein knitting the fabric comprises knitting a first progressive compression zone of the knit fabric, where a first compression value at a first longitudinal end of the progressive compression zone is greater than a second compression value at a second, opposite longitudinal end of the progressive compression zone.

23. The method of embodiment 22, wherein compression of the first progressive compression zone gradually decreases from the first longitudinal end to the second longitudinal end.

24. The method of embodiment 23, wherein knitting the fabric further comprises knitting a first constant compression zone adjacent the first progressive compression zone, wherein a compression value of the first constant compression zone is generally constant throughout the first constant compression zone, and the compression value of the first constant compression zone is the same as a compression value of an adjacent longitudinal end of the adjacent first compressive compression zone.

25. The method of embodiment 24, wherein knitting the fabric further comprises knitting a second progressive compression zone, a second constant compression zone, and a third constant compression zone;

where the first constant compression zone is positioned at an upper thigh area of the garment, the first progressive compression zone is positioned at a lower thigh area of the garment, the second constant compression zone is positioned at a knee area of the garment, the second progressive compression zone is positioned at a lower leg area of the garment, and the third constant compression zone is positioned at a foot of the garment.

26. The method of embodiment 15, wherein knitting the fabric excludes knitting an in-laid weft yarn.

27. The method of embodiment 15, wherein knitting the fabric comprises knitting a leg portion of the compression hosiery garment with the fabric.

28. The method of embodiment 27, further comprising knitting a panty portion of the compression hosiery garment, and connecting the panty portion to the leg portion to form the compression hosiery garment.

29. The method of embodiment 28, further comprising:

knitting a waistband portion;

connecting the waistband portion to the panty portion;

knitting a bottom end portion; and connecting the bottom end portion to the leg portion to form the compression hosiery garment.

What is claimed is:

1. A compression hosiery garment, comprising:

a knit fabric comprising a first yarn and a second yarn knit in an alternating knit construction comprising at least one course of the second yarn for each course of the first yarn, the first yarn comprising a covered yarn having an elastic core, the second yarn comprising an inelastic yarn, wherein the alternating knit construction comprises an inverse course shift in which the course of the first yarn is looser relative to the course of the second yarn, creating a course offset where the first yarn is knit with a first course height that is greater than a second course height of the second yarn, and wherein the course offset between the first course height and the second course height is between 0.2 millimeters and 0.6 millimeters.

2. The compression hosiery garment of claim 1, wherein the elastic core comprises a soft modulus of elasticity elastane core.

3. The compression hosiery garment of claim 1, wherein the covered yarn comprises an inelastic sheath over the elastic core.

4. The compression hosiery garment of claim 1, wherein at least a portion of the knit fabric comprises a compression value of at least 10 millimeter of mercury (mmHg).

5. The compression hosiery garment of claim 1, wherein the compression hosiery garment comprises a knitted leg portion, wherein the leg portion comprises bands of progressive or constant compression zones distributed along a longitudinal length of the leg portion, and wherein the garment comprises a first progressive compression zone of the knit fabric, where a first compression value at a first longitudinal end of the first progressive compression zone is greater than a second compression value at a second, opposite longitudinal end of the first progressive compression zone.

6. The compression hosiery garment of claim 5, further comprising a first constant compression zone adjacent to the second longitudinal end of the first progressive compression zone, wherein a compression value of the first constant compression zone is generally constant throughout the first constant compression zone, and the compression value of the first constant compression zone is the same as the second compression value of the second longitudinal end of the first progressive compression zone.

7. The compression hosiery garment of claim 6, further comprising a second progressive compression zone, a second constant compression zone, and a third constant compression zone;

where the first constant compression zone is positioned at an upper thigh area of the garment, the first progressive compression zone is positioned at a lower thigh area of the garment, the second constant compression zone is positioned at a knee area of the garment, the second progressive compression zone is positioned at a lower leg area of the garment, and the third constant compression zone is positioned at a foot of the garment.

8. The compression hosiery garment of claim 1, wherein the knit fabric excludes an in-laid weft yarn.

9. The compression hosiery garment of claim 2, wherein the covered yarn comprises an inelastic sheath over the elastic core.

10. The compression hosiery garment of claim 9, wherein the compression hosiery garment comprises a knitted leg portion, wherein the leg portion comprises bands of progressive or constant compression zones distributed along a longitudinal length of the leg portion, and wherein the garment comprises a first progressive compression zone of the knit fabric, where a first compression value at a first longitudinal end of the first progressive compression zone is greater than a second compression value at a second, opposite longitudinal end of the first progressive compression zone.

11. The compression hosiery garment of claim 3, wherein the inelastic sheath comprises one, two, or more inelastic wrapping fibers over the elastic core.

12. The compression hosiery garment of claim 5, wherein the compression value of the first progressive compression zone gradually decreases from the first longitudinal end to the second longitudinal end.

13. The compression hosiery garment of claim 12, further comprising a first constant compression zone adjacent to the second longitudinal end of the first progressive compression zone, wherein a compression value of the first constant compression zone is generally constant throughout the first constant compression zone, and the compression value of the first constant compression zone is the same as the second compression value of the second longitudinal end of the first progressive compression zone.

14. The compression hosiery garment of claim 1, wherein the knit fabric comprises a level of transparency between 15 Denier and 50 Denier.

15. The compression hosiery garment of claim 4, wherein the knit fabric comprises a level of transparency between 15 Denier and 50 Denier.

* * * * *